US006667005B2

(12) United States Patent
Ishida et al.

(10) Patent No.: US 6,667,005 B2
(45) Date of Patent: Dec. 23, 2003

(54) CORROSION RESISTANT STEEL

(75) Inventors: Kiyohito Ishida, 3-5-20, Kamisugi, Aoba-ku, Sendai-shi, Miyagi-ken (JP); Katsunari Oikawa, Shibata-machi (JP); Takashi Ebata, Murata-machi (JP); Koichi Ishikawa, Nagoya (JP); Toshiharu Noda, Nagoya (JP); Tetsuya Shimizu, Nagoya (JP)

(73) Assignees: Kiyohito Ishida, Sendai (JP); Dokuritsu Gyousei Houjin Sangyo Gijutsu Sougo Kenkyusho, Tokyo (JP); Daido Steel Co., LTD, Nagoya (JP)

( * ) Notice: Subject to any disclaimer, the term of this patent is extended or adjusted under 35 U.S.C. 154(b) by 20 days.

(21) Appl. No.: 10/144,838

(22) Filed: May 15, 2002

(65) Prior Publication Data

US 2003/0063995 A1 Apr. 3, 2003

(30) Foreign Application Priority Data

May 16, 2001 (JP) ..... 2001-147026

(51) Int. Cl.[7] ..... C22C 38/18; C22C 38/60

(52) U.S. Cl. ..... 420/84; 420/87; 420/112; 148/333; 148/334; 148/335

(58) Field of Search ..... 420/84, 87, 112; 148/333, 334, 335

(56) References Cited

U.S. PATENT DOCUMENTS 6,475,305 B1 * 11/2002 Watari et al.

FOREIGN PATENT DOCUMENTS

| | | | | |
|---|---|---|---|---|
| JP | 360174854 | * | 9/1985 | ..... 420/84 |
| JP | 402138439 | * | 5/1990 | |

* cited by examiner

*Primary Examiner*—Deborah Yee
(74) *Attorney, Agent, or Firm*—Varndell & Varndell, PLLC

(57) ABSTRACT

Disclosed is a corrosion resistant steel having good machinability with sufficient corrosion resistance in the ordinary indoor circumstances and suitable for manufacturing shafts of various small motors and OA-machines. The steel comprises, by weight %, C: 0.005–0.200%, P: up to 0.05%, Cu: up to 2.0%, Ni: up to 2.0%, Cr: 2.0–9.0%, one or both of Ti and Zr: in such an amount as [Ti %]+0.52[Zr %]: 0.03–1.20%, one or both of S: 0.01–0.50% and Se: 0.01–0.40%, N: up to 0.050% and O: up to 0.030%, the balance being Fe and inevitable impurities. The steel is characterized by the inclusion therein, which are Ti-based, Zr-based or Ti-Zr-based compound or compounds containing C and one or both of S and Se.

10 Claims, 1 Drawing Sheet

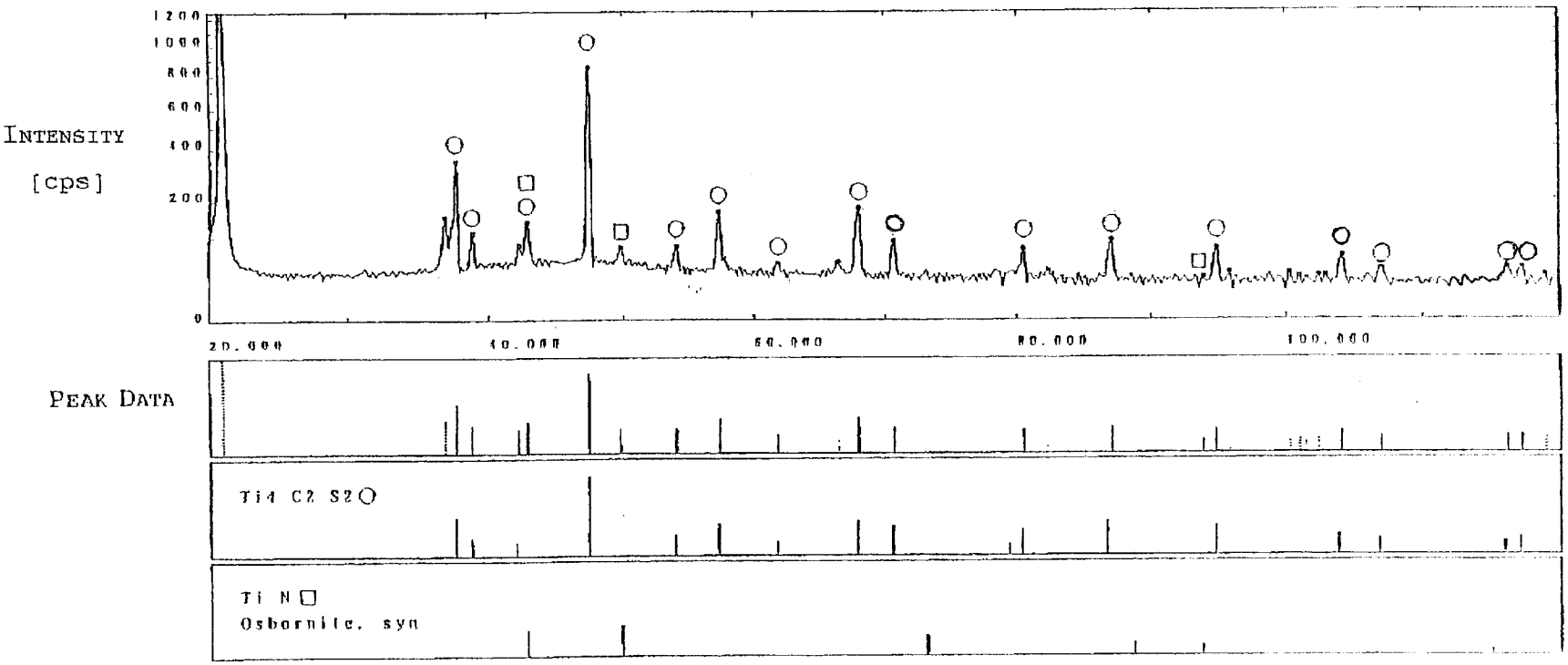
INTENSITY
[cps]
1200
1000
800
600
400
200
0
20.000
40.000
60.000
80.000
100.000
PEAK DATA
Ti4 C2 S2O
Ti N
Osbornite, syn

CORROSION RESISTANT STEEL

BACKGROUND OF THE INVENTION

The present invention concerns a corrosion resistant steel. More specifically, the invention concerns a corrosion resistant steel suitable for use as the material for shafts of OA-machines such as printers.

Requisites to the material for parts of machines of indoor use, such as so-called OA-machines, are good cold workability and machinability, and further, such corrosion resistance as sufficient to endure under indoor circumstances. Recently, of the OA-machines personal computers have come into wide use, and with this, demand for printers has been increasing. The printers have plural shafts such as paper-supplier shaft and platen shafts. In order to reduce the costs for producing the printers it is necessary to reduce the costs for the shafts.

To date as the materials for the shafts of laser printers the following stainless steels have been used:

SUS420J2 (C: 0.26–0.40%, Si: up to 1.0%, Mn: up to 1.0%, P: up to 0.040%, S: up to 0.040%, Cr: 12.0–14.0%, the balance being substantially Fe), and SUS410 (C: up to 0.15%, Si: up to 1.0%, Mn: up to 1.0%, P; up to 0.040%, S: up to 0.030%, Cr: 11.5–13.5%, the balance being substantially Fe).

On the other hand, as the shafts of inkjet printers such as color printers, those produced of the free-cutting steels mentioned below which are machined and nickel-plated have been used.

SUM24L (C: up to 0.15%, Mn: 0.85–1:15%, P: 0.040–0.090%, S: 0.26–0.35%, Pb: 0.10–0.35%, the balance being substantially Fe), and SUM22 (C: up to 0.13%, Mn: 0.70–1.00%, P: 0.07–0.12%, S: 0.24–0.35%, the balance being substantially Fe), and Because it is satisfactory that this kind of shafts have such corrosion resistance as to endure indoor circumstances, the above-mentioned expensive stainless steel, SUS420J2 and SUS410, are not appropriate materials from the viewpoint of cost-performance balance. In electroplating machined parts made of free-cutting steel as SUM24L it has been experienced that the quality of the products varies due to fluctuating thickness and defects in the plated metal layer, which results in lowered liability of the products. Further, it is necessary to consider, from the view to avoid environmental pollution, treatment of the waste solution occurring from electroplating. The expense for the treatment of the waste solution is getting higher, and thus, it cannot be said that the costs for producing the shafts according to the conventional technology are not important.

It should be noted that straightness is another problem common to the shafts.

In order to solve these problems the inventors have conducted research and development with the intention to provide a steel which has good machinability and straightness, sufficient corrosion-resistance to endure under the indoor circumstances, and further, is not expensive. As the result, they have discovered that addition of certain amounts of one or both of S and Se, and one or both of Ti and Zr to the steel containing C: 0.005–0.200%, Si: up to 1.0%, Mn: up to 2.0%, P: up to 0.05%, Cu: up to 2.0%, Ni: up to 2.0%, Cr: 2.0–9.0%, the balance being substantially Fe, results in formation of Ti-based compounds, Zr-based compounds or Ti—Zr-based compounds containing C and one or two of S and Se such as $(Ti,Zr)_4(S,Se)_2C_2$ in the steel, and that fine dispersion of these compounds in the steel improves machinability of the steel and brings about good corrosion resistance, cold workability and hot workability of the steel.

SUMMARY OF THE INVENTION

The object of the present invention is to utilize the above discovery by the inventors and to provide a steel which has good machinability and straightness, sufficient corrosion-resistance to endure under the indoor circumstances, and is less expensive.

BRIEF EXPLANATION OF THE DRAWING

The attached single drawing is an X-ray deflection chart of the Ti-based, Zr-based or Ti—Zr-based compounds formed in the steel of the present invention and containing C and one or both of S and Se.

DETAILED EXPLANATION OF THE PREFERRED EMBODIMENTS

The corrosion resistant steel according to the present invention suitable for the use such as printer shafts has a basic alloy composition consisting essentially of, by weight %, C: 0.005–0.200%, Si: up to 1.0%, Mn: up to 2.0%, P: up to 0.05%, Cu: up to 2.0%, Ni: up to 2.0%, Cr: 2.0–9.0%, one or both of Ti and Zr: in such an amount as [Ti %]+0.52[Zr %]: 0.03–1.20%, one or both of S: 0.01–0.50% and Se:0.01–0.40%, N: up to 0.050% and O: up to 0.030%, the balance being Fe and inevitable impurities, and the steel containing, as the inclusion therein, Ti-based, Zr-based or Ti—Zr-based compound or compounds containing C and one or both of S and Se.

The corrosion resistant steel suitable for the shafts according to the invention may contain, in addition to the alloy components mentioned above, one or more of the element or elements of one or more of the following groups.

1) One or both of Mo: 0.1–4.0% and W: 0.1–3.0%;

2) At least one from the group of Pb: 0.01–0.30%, Te: 0.005–0.100% and Bi: 0.01–0.20%:

3) At least one of Ca, Mg, B and REM: 0.005–0.010%; and

4) At least one of Nb, V, Ta and Hf: 0.01–0.50%.

The following explains the roles of alloy component members and the reasons for limiting the compositions.

C: 0.005–0.200%, preferably, 0.010–0.100%

Carbon is an essential element which forms the inclusions to improve machinability of the steel. A C-content less than 0.005% may not give sufficient amount of machinability-improving inclusions. A content more than 0.200% gives large amount of single carbides, which lowers the machinability. Preferable range is 0.010–0.100%.

Si: up to 1.0%

Silicon is added as a deoxidizer to the steel. Too much addition heightens hardness of the steel after solution treatment resulting in lowered cold workability, and further, increases (δ-ferrite formation resulting in decrease of hot workability and corrosion resistance. Therefore, the upper limit is set to be 1.0%. In cases where the machinability and the straightness are particularly important, Si-content should be so low as up to 0.15%.

Mn: up to 2.0%

Manganese not only is a deoxidizer but also improves machinability of the steel by forming compounds together with S and Se. MnS formed by combination of Mn and S significantly lowers the corrosion resistance and decreases cold workability and straightness, and thus, the content of Mn is limited to 2.0%. If the corrosion resistance and the cold workability must be high, then it is preferable to limit Mn to 0.40% or less.

P: up to 0.05%

Phosphor is one of the impurities in the steel which heightens sensibility of grain boundary corrosion, and lowers resilience of the steel. Therefore, the lower the P-content is, the better. It is, however, very expensive to extremely lower the P-content, and therefore, the allowable limit is 0.05%. Preferable P-content is up to 0.03%.

Cu: up to 2.0%

Copper is an effective element for increasing corrosion resistance, particularly, corrosion resistance under the reducing conditions. Excess addition causes decrease in hot workability, and the upper limit of Cu-content is determined to 2.0%.

Ni: up to 2.0%

Ni is an element which improves corrosion resistance. Addition in a large amount of Ni makes the product steel expensive, and thus, the upper limit of addition is set to be 2.0%. In order to ensure sufficient corrosion resistance and good straightness it is preferable to add Ni in an amount of 0.3–0.8%.

Cr: 2.0–9.0%

Chromium is also an element which improves corrosion resistance. Unless the Cr-amount is less than 2.0%, the effect is insufficient, but addition of more than 9.0% Cr lowers the straightness, workability and machinability of the steel. Also, the costs will increase. Preferable range of addition amount is 6.0–9.0%.

One or both of Ti and Zr, [Ti %]+0.52[Zr %]: 0.03–1.20%

Titanium and zirconium, when exist in the steel together with C and S and/or Se, form the compounds such as $(Ti,Zr)_4(S,Se)_2C_2$, or (Ti,Zr) (S,Se) to improve machinability. Particularly, the former compound contributes improvement in the machinability without damaging the corrosion resistance and without damaging the cold workability due to the fine distribution in the steel. To ensure these effects it is necessary to have Ti and Zr added in such an amount as [Ti %]+0.52[Zr %] is 0.03% or more. An excess amount more than 1.20% causes formation of hard inclusions such as TiN and $TiO_2$, and at the same time, hardness of the matrix steel becomes high.

One or both of S; 0.01–0.50% and Se: 0.01–0.40%

Sulfur and Selenium form, as explained above, when they coexist with C and Ti and/or Zr, compounds such as $(Ti,Zr)_4(S,Se)_2C_2$, or (Ti,Zr) (S,Se) to improve machinability. In order to have these compounds formed in preferable amounts it is necessary to add S: 0.01% or more and/or Se: 0.01% or more. If the content or contents of S and/or Se are excess, hot workability and resilience of the steel is damaged. Thus, the upper limits are 0.50% for S and 0.40% for Se.

N: up to 0.050%

Nitrogen is also one of the impurities in the steel. Because N deprives Ti and Zr in the steel, which are necessary elements for forming the compounds improving the machinability, to form nitrides, which are harmful to the machinability. It is necessary to decrease the N-content as low as possible. On the other hand, extreme reduction of N-content causes increase in the production costs. As the allowable limit 0.050% is set. Preferable N-content is up to 0.025%, and more preferably, up to 0.010%.

O: up to 0.030%

Oxygen is also an impurity in the steel. O combines with Ti and Zr, which are necessary for forming machinability-improving compounds, to form oxides, which damage machinability of the steel. Therefore, it is necessary to reduce the O-content as low as possible. However, extreme reduction of O-content also causes increase in the production costs. Allowable limit is set to 0.030%. Preferably, O-content is 0.010% or less.

The following explains the effects of addition and the reasons for limiting the ranges of the above mentioned optionally added alloy components.

One or both of Mo: 0.1–4.0% and W: 0.1–3.0%

Both molybdenum and tungsten enhance corrosion resistance of the present steel, if added. To obtain the effect it is necessary to add one or both of Mo and W in an amount of 0.1% or more. Addition of a large amount will damage cold workability of the steel. Thus, the upper limit of addition is set to 4.0% for Mo and 3.0% for W.

At least one from the group of Pb; 0.01–0.30%, Te: 0.005–0.100% and Bi: 0.01–0.20%

Lead, tellurium and bismuth also enhance the corrosion resistance of the steel. Necessary least amounts of addition for ensuring the effect are 0.01% for Pb, 0.005% for Te and 0.01% for Bi. Excess addition of these elements will damage hot workability of the steel, and therefore, the upper limits, 0.30% for Pb, 0.10% for Te and 0.20% for Bi are given.

At least one of Ca, Mg, B and REM: 0.005–0.010%

Calcium, magnesium and rare earth metals improve hot workability of the steel. The effect can be obtained by sole or combined addition of the element or elements in an amount (in case of combined addition, in total) of 0.005% or more. However, too much addition will give reverse effect to the hot workability, and therefore, the addition must be in an amount up to 0.010%.

At least one of Nb, V, Ta and Hf: 0.01–0.50%

Niobium, vanadium, tantalum and hafnium form carbonitrides thereof to make crystal grains of the steel fine and heighten resilience of the steel. Sole or combined addition of these elements in an amount (in case of combined addition, in total) of 0.01% or more will give this effect. Excess addition causes formation of coarse carbonitrides, which reversely decrease the resilience of the steel. The upper limit of addition is 0.50%.

The corrosion resistant steel of this invention can be manufactured in accordance with the known technology. This is because the present steel is a steel prepared by adding the specific amounts of one or both of Ti and Zr, and carbon, and one or both of S and Se to the known steel containing 2.0–9.0% Cr or the like.

According to the above-explained mechanism the present corrosion resistant steel has good machinability as well as good straightness, and further, sufficient corrosion resistance for indoor use. The steel is less expensive than the conventional ferritic stainless steels because of reduced Cr-content.

EXAMPLES

The following illustrates the examples of the present invention.

The molten steels having the alloy compositions shown in TABLE 1 (working examples) and TABLE 2 (control examples) were prepared and cast into ingots. In the TABLES the column "X" is "[Ti %]+0.52[Zr %]".

The ingots were bloomed into slabs of 155 mm square section, and the slabs were wire-rolled to wires of diameter 9.5 mm. The obtained wires were annealed and de-scaled, and then, changed into straight wires, and finally finished by a centerless grinder to wires of diameter 8 mm. The testing wires thus prepared were used for the various tests described below.

TABLE 1

Alloy Compositions of Examples (wt. %, balance Fe and impurities)

| No. | C | Si | Mn | P | Cu | Ni | Cr | N | O | Ti, Zr | X | S, Se | Others |
|---|---|---|---|---|---|---|---|---|---|---|---|---|---|
| 1 | 0.029 | 0.08 | 0.35 | 0.01 | 0.05 | 0.32 | 8.22 | 0.008 | 0.004 | Ti0.58 | 0.58 | S0.19 | — |
| 2 | 0.149 | 0.12 | 1.34 | 0.02 | 0.19 | 0.54 | 8.66 | 0.016 | 0.006 | Ti1.15 | 1.15 | 50.33 Se0.13 | — |
| 3 | 0.103 | 0.15 | 0.35 | 0.02 | 0.45 | 0.87 | 6.89 | 0.009 | 0.002 | Ti0.52 Zr0.61 | 0.84 | S0.28 | Mo0.5 |
| 4 | 0.021 | 0.09 | 0.89 | 0.02 | 1.33 | 0.23 | 8.05 | 0.007 | 0.008 | Ti0.14 | 0.14 | S0.05 | Bi0.13 |
| 5 | 0.159 | 0.02 | 0.80 | 0.02 | 0.45 | 0.48 | 7.99 | 0.007 | 0.009 | Ti1.01 Zr0.34 | 1.19 | S0.42 | Ca0.0 033 |
| 6 | 0.111 | 0.07 | 0.52 | 0.02 | 0.13 | 0.52 | 8.52 | 0.004 | 0.001 | Ti0.05 | 1.05 | S0.34 | W2.1 Mg0.0018 |
| 7 | 0.095 | 0.03 | 1.83 | 0.01 | 0.59 | 0.43 | 8.33 | 0.004 | 0.005 | Ti0.89 | 0.89 | S0.25 Se0.11 | — |
| 8 | 0.072 | 0.13 | 0.56 | 0.02 | 0.22 | 0.98 | 8.94 | 0.008 | 0.005 | Ti0.77 | 0.77 | S0.25 | B 0.0023 |
| 9 | 0.146 | 0.14 | 0.44 | 0.02 | 1.21 | 1.53 | 5.22 | 0.013 | 0.009 | Ti1.17 | 1.17 | S0.47 | Ta0.11 REM0.0025 |
| 10 | 0.100 | 0.09 | 0.33 | 0.02 | 0.38 | 0.55 | 8.81 | 0.023 | 0.009 | Ti0.85 | 0.85 | S0.28 | Nb0.23 |
| 11 | 0.094 | 0.01 | 0.75 | 0.01 | 0.54 | 0.67 | 8.77 | 0.019 | 0.011 | Ti0.94 | 0.94 | S0.31 Hf0.25 | Mo2.8 B0.0022 |
| 12 | 0.133 | 0 05 | 1.57 | 0.02 | 0.82 | 0.32 | 7.32 | 0.041 | 0 004 | Ti1.16 | 1.16 | S0.38 | Pb0.17 |
| 13 | 0.075 | 0.12 | 0.94 | 0.03 | 0.19 | 0.92 | 8.56 | 0.012 | 0.007 | Ti0.68 | 0.68 | S0.22 | Mo2.2 Te 0.03 |
| 14 | 0.096 | 0.09 | 0.67 | 0.02 | 0.29 | 0.63 | 8.03 | 0.008 | 0.005 | Ti0.82 | 0.82 | S0.28 | Mo1.4 Te0.02 |
| 15 | 0.095 | 0.10 | 0.28 | 0.01 | 0.23 | 0.32 | 6.72 | 0.020 | 0.013 | Zr1.44 | 0.75 | S0.31 | — |
| 16 | 0.139 | 0.11 | 0.91 | 0.03 | 0.41 | 0.33 | 7.88 | 0.013 | 0.007 | Ti1.11 | 1.11 | Se0.33 | — |
| 17 | 0.105 | 0.15 | 0.35 | 0.02 | 0.45 | 0.87 | 3.89 | 0.009 | 0.002 | Ti0.51 | 0.83 | S.26 | — Zr0.61 |
| 18 | 0.022 | 0.09 | 0.89 | 0.02 | 1.33 | 0.23 | 2.98 | 0.007 | 0.008 | Ti0.11 | 0.11 | S0.07 | — |
| 19 | 0.161 | 0.02 | 0.39 | 0.01 | 0.45 | 0.48 | 4.55 | 0.007 | 0.009 | Ti0.90 | 1.17 | S0.41 | — Zr0.52 |
| 20 | 0.110 | 0.07 | 0.52 | 0.02 | 0.13 | 0.52 | 6.22 | 0.004 | 0.001 | Ti1.07 | 1.07 | S0.33 | — |
| 21 | 0.070 | 0.13 | 0.56 | 0.02 | 0.22 | 0.98 | 3.44 | 0.008 | 0.005 | Ti0.80 | 0.80 | S0.26 | — |
| 22 | 0.200 | 0.14 | 0.44 | 0.02 | 1.21 | 1.63 | 5.99 | 0.013 | 0.009 | Ti1.15 | 1.15 | S0.48 Se0.18 | — |
| 23 | 0.098 | 0.09 | 0.33 | 0.02 | 0.38 | 0.55 | 4.75 | 0.023 | 0.009 | Ti0.88 | 0.88 | S0.37 | — |
| 24 | 0.093 | 0.01 | 0.75 | 0.01 | 0.54 | 0.67 | 3.35 | 0.019 | 0.011 | Ti0.89 | 0.89 | S0.32 | — |

TABLE 2

Alloy Compositions, Controls (wt. %, balance Fe and impurities)

| No. | C | Si | Mn | P | Cu | Ni | Cr | N | O | Ti, Zr | X | S, Se | Others |
|---|---|---|---|---|---|---|---|---|---|---|---|---|---|
| 1 | 0.002 | 1.05 | 0.05 | 0.02 | 0.15 | 0.24 | 8.41 | 0.008 | 0.003 | Ti0.19 | 0.19 | S0.33 | — |
| 2 | 0.002 | 0.19 | 0.88 | 0.02 | 0.17 | 2.11 | 1.88 | 0.018 | 0.002 | Ti0.39 | 0.89 | S0.21 | — |
| 3 | 0.016 | 0.23 | 0.29 | 0.02 | 0.13 | 0.77 | 9.32 | 0.053 | 0.005 | Ti1.01 | 1.01 | S0.32 | — |
| 4 | 0.019 | 0.33 | 2.03 | 0.01 | 0.25 | 0.47 | 8.28 | 0.011 | 0.012 | Ti1.05 | 1.05 | S0.42 | — |
| 5 | 0.005 | 0.45 | 1.13 | 0.01 | 0.10 | 0.88 | 1.53 | 0.023 | 0.007 | Ti0.01 | 0.01 | S0.21 | — |

Sample pieces of diameter 8 mm and length 500 mm were cut from the above testing wires, and the sample pieces were subjected to the following tests to determine the machinability, corrosion resistance and straightness.

[Machinability]

Machinability of the present steel was evaluated by cutting outer surfaces of 500 samples under the conditions below and measuring abrasion of the cutting tools.

Tools: bites made of sintered carbide

Cutting Speed: 150 mm/min.

Feed: 0.05 mm/rev.

Depth: 1 mm

The tool abrasion was ranked into "Mild", "Intermediate" and "Significant" as shown in TABLE 2 below.

TABLE 2

| Abrasion at | Mild | Intermediate | Significant |
|---|---|---|---|
| Side Clearance | less than 100 μm | 100–500 μm | more than 500 μm |
| Front Clearance | less than 100 μm | 100–200 μm | more than 200 μm |

[Corrosion Resistance]

The samples were kept in an atmosphere of high temperature and high humidity, i.e., 60° C. and 95%N, for 240 hours, and thereafter, occurrence of rust was observed and recorded.

[Straightness]

The sample pieces were set on two supporting points with distance of 400 mm and rotated, and running-out at the center of the test pieces were measured with a dial gaze. The dimension of the measurement is "μm/width 400 mm". The results were evaluated as shown below.

Mild: 0–10 μm/400 mm
Intermediate: over 10 to 30 μm/400 mm
Significant: over 30 to 100 μm/400 mm
The results are shown in Table 3 below.

TABLE 3

| No. | | (Rust Occurrence) Machinability | Corrosion Resistance | Straightness |
|---|---|---|---|---|
| Examples | 1–24 | good | no rust | good |
| Control | 1 | no good | good | no good |
| | 2 | good | good | no good |
| | 3 | no good | no rust | no good |
| | 4 | good | good | no good |
| | 5 | no good | good | slightly no good |

From the results in TABLE 3, it was ascertained that the working examples of the present invention have such good machinability as the tool abrasions, which are measures for the machinability, are less than 100 μm at both the side and the front clearances. In the corrosion resistance tests, no rust was observed and high resistance was proved. The curve of the test piece wires after finishing with the centerless grinder was such smaller values than those of the control examples that good straightness was concluded.

Contrary to this, in Control 1, in which C-content was lower and Si-content was higher than the present invention, tool abrasion was high, rust occurred in corrosion test, and the curve showing the straightness was significant. In Control 2, in which C-content was lower and Cr-content was also lower than those of the invention, though the tool abrasion was mild, rust occurred in the corrosion test and the curve was large. In Control 3, which contained larger amounts of C and N than the invention, the tool abrasion was significant and the curve was also large. Control 4 containing Mn in much more amount than the claimed invention could not withstand the corrosion test, and further, showed larger curve in straightness test. Finally, Control 5 containing less amount of Ti than the invention showed significant tool abrasion or lower machinability, and also, rust was observed in the corrosion test.

In order to analyze the inclusions in the steel, sample of Run No.1 was subjected to electrolysis extraction, and the residue was identified with X-ray deflection analyzer. As seen in FIG. 1, existence of $Ti_4C_2S_2$ was ascertained.

We claim:

1. A corrosion resistant steel comprising, by weight %, C:0.005–0.200%, Si: up to 1.0%, Mn: up to 2.0%, P: up to 0.05%, Cu: up to 2.0%, Ni: up to 2.0%, Cr: 2.0–9.0%, one or both of Ti and Zr: in such an amount as [Ti %]+0.52[Zr %]: 0.03–1.20%, one or both of S: 0.01–0.50% and Se: 0.01–0.40%, N: up to 0.050% and O: up to 0.030%, the balance being Fe and inevitable impurities, and the steel containing, as the inclusion therein, Ti-based, Zr-based or Ti—Zr-based compound or compounds containing C and one or both of S and Se.

2. A corrosion resistant steel according to claim 1, wherein the steel contains, in addition to the alloy components set forth in claim 1, by weight %, one or both of Mo: 0.1–4.0% and W: 0.1–3.0%.

3. A corrosion resistant steel according to claim 1, wherein the steel contains, in addition to the alloy components set forth in claim 1, by weight %, at least one from the group of Pb: 0.01–0.30%, Te: 0.005–0.100% and Bi: 0.01–0.20%.

4. A corrosion resistant steel according to claim 1, wherein the steel contains, in addition to the alloy components set forth in claim 1, by weight %, at least one of Ca, Mg, B and REM: 0.005–0.010%.

5. A corrosion resistant steel according to claim 1, wherein the steel contains, in addition to the alloy components set forth in claim 1, by weight %, at least one of Nb, V, Ta and Hf: 0.01–0.50%.

6. A shaft for a printer made of the corrosion resistant steel according to claim 1.

7. A shaft for a printer made of the corrosion resistant steel according to claim 2.

8. A shaft for a printer made of the corrosion resistant steel according to claim 3.

9. A shaft for a printer made of the corrosion resistant steel according to claim 4.

10. A shaft for a printer made of the corrosion resistant steel according to claim 5.

* * * * *